US009164432B2

(12) United States Patent
Kobayashi

(10) Patent No.: US 9,164,432 B2
(45) Date of Patent: Oct. 20, 2015

(54) DEVELOPING DEVICE AND IMAGE FORMING APPARATUS HAVING THE SAME

(71) Applicant: KYOCERA Document Solutions Inc., Osaka-shi, Osaka (JP)

(72) Inventor: Kiyotaka Kobayashi, Osaka (JP)

(73) Assignee: KYOCERA Document Solutions Inc., Osaka-shi (JP)

( * ) Notice: Subject to any disclaimer, the term of this patent is extended or adjusted under 35 U.S.C. 154(b) by 0 days.

(21) Appl. No.: 14/333,965

(22) Filed: Jul. 17, 2014

(65) Prior Publication Data

US 2015/0023701 A1 Jan. 22, 2015

(30) Foreign Application Priority Data

Jul. 22, 2013 (JP) ..... 2013-151302

(51) Int. Cl.
*G03G 15/09* (2006.01)

(52) U.S. Cl.
CPC ..... *G03G 15/0921* (2013.01); *G03G 15/0935* (2013.01)

(58) Field of Classification Search
CPC ..... G03G 15/0921; G03G 15/0928; G03G 15/09; G03G 15/0812
USPC ..... 399/277
See application file for complete search history.

(56) References Cited

U.S. PATENT DOCUMENTS 4,874,346 A * 10/1989 Wachspress ..... 446/484

FOREIGN PATENT DOCUMENTS

JP 2011013248 A 1/2011

OTHER PUBLICATIONS

Machine translation of JP 2001-125379 A, publication date: May 11, 2001.*
Machine translation of JP 2011-013248 A, publication date: Jan. 20, 2011.*
Machine translation of JP 2012-118361 A , publication date: Jun. 21, 2012.*

* cited by examiner

*Primary Examiner* — Walter L Lindsay, Jr.
*Assistant Examiner* — Frederick Wenderoth
(74) *Attorney, Agent, or Firm* — Alleman Hall McCoy Russell & Tuttle LLP

(57) ABSTRACT

A developing device includes a magnetic roller, a developing roller, a cover, a first magnetic force generator, a second magnetic force generator with a different polarity, and a movement controller. A roller surface of the magnetic roller holds toner and magnetic carrier, the toner being adhered to the magnetic carrier. The developing roller is arranged to face the magnetic roller. The first magnetic force generator is provided inside the magnetic roller such that a magnetic pole face thereof faces the developing roller. The second magnetic force generator is provided inside the developing roller so as to be able to move between a first position and a second position. A magnetic pole face of the second magnetic force generator faces the magnetic roller at the first position and faces the cover at the second position. The movement controller causes the second magnetic force generator to move between positions.

8 Claims, 6 Drawing Sheets

DEVELOPING DEVICE AND IMAGE FORMING APPARATUS HAVING THE SAME

INCORPORATION BY REFERENCE

This application is based upon and claims the benefit of priority from the corresponding Japanese Patent Application No. 2013-151302 filed on Jul. 22, 2013, the entire contents of which are incorporated herein by reference.

BACKGROUND

The present disclosure relates to a developing device for developing an electrostatic latent image on an image-carrying member by causing the image-carrying member to hold toner, and to an image forming apparatus including the developing device.

An image forming apparatus, such as a copier, a printer or the like, that forms an image on a sheet of paper by the electrophotographic method is provided with a developing device. The developing device uses toner to develop an electrostatic latent image formed on an image-carrying member such as a photosensitive drum. As the developing method, there is known a so-called two-component developing method that uses two-component developer composed of magnetic carrier and toner to develop a toner image on the image-carrying member. According to a typical two-component developing method, a developing roller and a magnetic roller are used, wherein the developing roller is arranged at a predetermined distance from the image-carrying member, and a magnet is provided inside the magnetic roller. According to the two-component developing method, only non-magnetic toner is transferred onto the developing roller while the magnetic carrier is left on the magnetic roller, so that a toner thin layer is formed on the developing roller. An AC electric field is then supplied to cause the toner to be flied from the developing roller onto the electrostatic latent image formed on the image-carrying member, so that the toner adheres to the electrostatic latent image.

SUMMARY

A developing device according to one aspect of the present disclosure includes a magnetic roller, a developing roller, a cover, a first magnetic force generator, a second magnetic force generator, and a movement controller. A roller surface of the magnetic roller holds toner and magnetic carrier, the toner being adhered to the magnetic carrier. The developing roller is arranged to face the magnetic roller. The cover is arranged at a predetermined distance from a roller surface of the developing roller and covers the developing roller. The first magnetic force generator is provided inside the magnetic roller in a state where a magnetic pole face of the first magnetic force generator faces the developing roller. The second magnetic force generator is provided inside the developing roller so as to be able to move between a first position and a second position. A magnetic pole face of the second magnetic force generator faces the magnetic roller at the first position and faces the cover at the second position. The first magnetic force generator and the second magnetic force generator have different polarities. The movement controller causes the second magnetic force generator to move from the first position to the second position, and subsequently to move to the first position.

An image forming apparatus according to another aspect of the present disclosure includes the developing device.

This Summary is provided to introduce a selection of concepts in a simplified form that are further described below in the Detailed Description with reference where appropriate to the accompanying drawings. This Summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

DETAILED DESCRIPTION

The following describes an embodiment of the present disclosure with reference to the drawings for the understanding of the disclosure.

Figure 1:
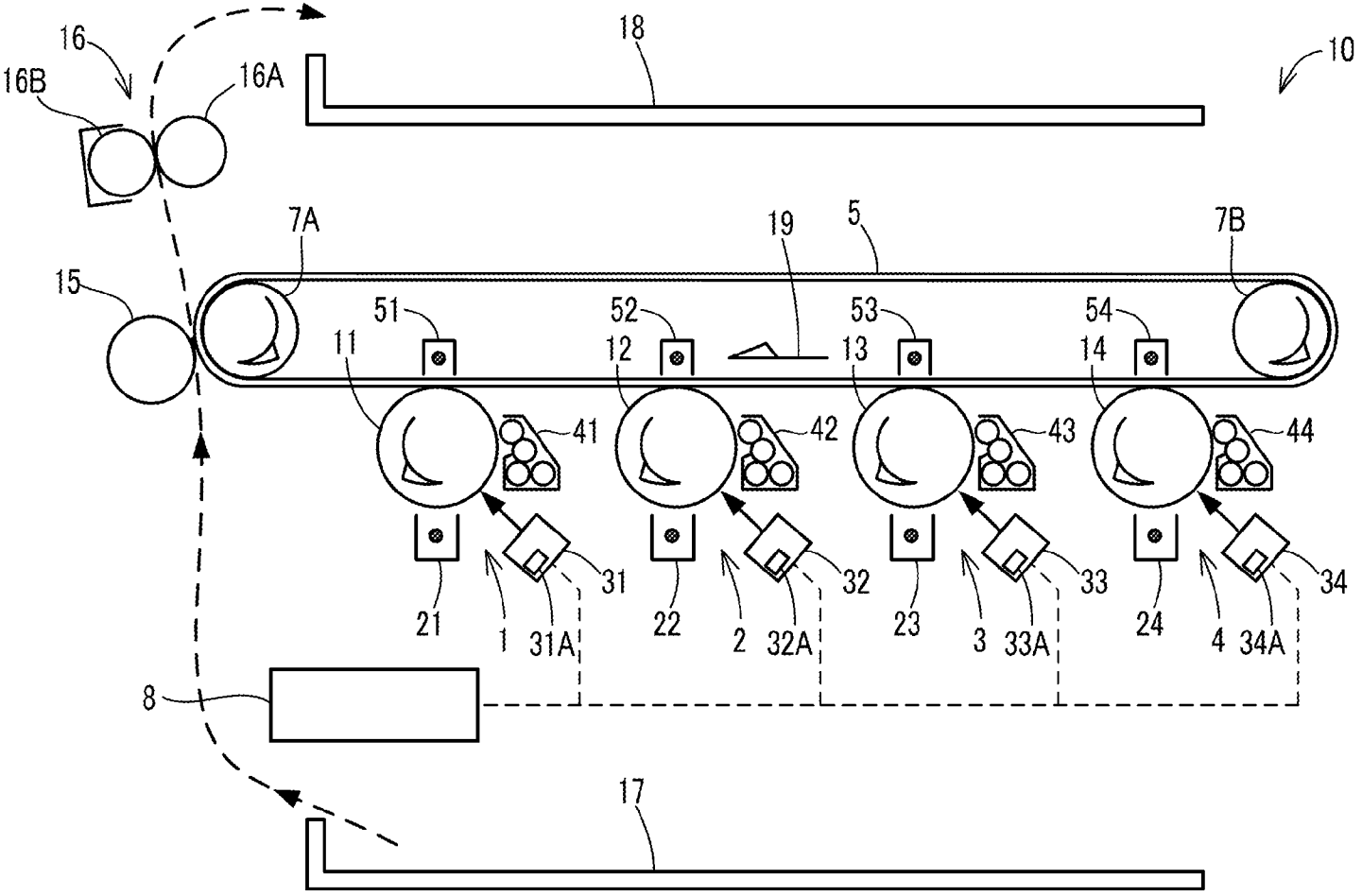
FIG. 1 is a schematic diagram showing the structure of the image forming apparatus in the embodiment of the present disclosure.

FIG. 1 is a schematic diagram showing the structure of an image forming apparatus 10 (an example of the image forming apparatus of the present disclosure) in an embodiment of the present disclosure. As shown in FIG. 1, the image forming apparatus 10 is a so-called tandem system color image forming apparatus. The image forming apparatus 10 includes a plurality of image forming portions 1-4, an intermediate transfer belt 5, a driving roller 7A, a driven roller 7B, a second transfer device 15, a fixing device 16, a controller 8, a paper feed tray 17, an ejected paper tray 18, a stepping motor 86, and a stepping motor 87. Note that the image forming apparatus 10 may be, for example, a multifunction peripheral having functions of a printer, a copier and a facsimile.

The image forming portions 1-4 perform the image forming process based on the electrographic method. The image forming portions 1-4 form toner images of different colors respectively for photosensitive drums 11-14 (an example of the image-carrying member of the present disclosure) arranged in parallel, and transfer the toner images onto the intermediate transfer belt 5 in sequence while the intermediate transfer belt 5 is running (moving) so that the images are overlaid with each other. In order from the downstream side in the movement direction (the direction indicated by arrow 19) of the intermediate transfer belt 5, an image forming portion 1 for black, an image forming portion 2 for yellow, an image forming portion 3 for cyan, and an image forming portion 4 for magenta are arranged in a row.

The image forming portions 1-4 include the photosensitive drums 11-14, charging devices 21-24, exposing devices 31-34, developing devices 41-44 (an example of the developing device of the present disclosure), first transfer devices 51-54 and the like, respectively. The photosensitive drums

11-14 carry toner images on the surfaces thereof. The charging devices 21-24 charge the surfaces of the corresponding photosensitive drums 11-14 to a predetermined potential. The exposing devices 31-34 expose the charged surfaces of the photosensitive drums 11-14 to light, and write the electrostatic latent images thereon by scanning the light thereon. The developing devices 41-44 develop the electrostatic latent images on the photosensitive drums 11-14 by toner. The first transfer devices 51-54 transfer the toner images from the rotating photosensitive drums 11-14 onto the intermediate transfer belt 5. Note that although not shown in FIG. 1, the image forming apparatuses 1-4 also include cleaning devices for removing remaining toner from the surfaces of the photosensitive drums 11-14.

The intermediate transfer belt 5 is, for example, a belt having a shape of an endless loop and is made of rubber, urethane or the like. The intermediate transfer belt 5 is supported by the driving roller 7A and the driven roller 7B so as to be driven to rotate. The driving roller 7A is located close to the fixing device 16 (on the left side in FIG. 1), and the driven roller 7B is located away from the fixing device 16 (on the right side in FIG. 1). The surface of the driving roller 7A is made of, for example, a material such as rubber, urethane or the like that increase friction force with the intermediate transfer belt 5. Being supported by the driving roller 7A and the driven roller 7B, the intermediate transfer belt 5 moves (runs), with its surface contacting with the surfaces of the photosensitive drums 11-14. When the intermediate transfer belt 5 passes the spaces between the photosensitive drums 11-14 and the first transfer devices 51-54, the toner images are transferred in sequence from the photosensitive drums 11-14 onto the surface of the intermediate transfer belt 5 so that the images are overlaid with each other.

The second transfer device 15 transfers the toner image from the intermediate transfer belt 5 to a printing paper sheet that is transported from the paper feed tray 17. The printing paper sheet having the toner image transferred thereon is transported to the fixing device 16 by a not-shown transport device. The fixing device 16 includes a heating roller 16A and a pressing roller 16B. The heating roller 16A is heated to approximately 2000° C. or more. The pressing roller 16B is arranged to face the heating roller 16A. The printing paper sheet transported to the fixing device 16 is transported while being nipped by the heating roller 16A and the pressing roller 16B. This allows for the toner image to be welded to the printing paper sheet. The printing paper sheet is then ejected onto the ejected paper tray 18.

The stepping motor 86 is a driving source for supplying the rotational driving force to each portion. The stepping motor 86 supplies the rotational driving force, via a transmission mechanism 88 such as gears (see FIG. 3), to a developing roller 63, a magnetic roller 62, a first stirring screw 61A, and a second stirring screw 61B that are included in each of the developing devices 41-44. The stepping motor 87 is a driving source for supplying the rotational driving force to a developing-roller-side magnetic pole 63B. The stepping motor 87 supplies the rotational driving force, via a transmission mechanism 89 such as gears (see FIG. 3), to the developing-roller-side magnetic pole 63B included in each of the developing devices 41-44. When the stepping motors 86 and 87 are driven and controlled by a motor driver 85 described below, the developing roller 63, the developing-roller-side magnetic pole 63B and the like are rotated. Note that although the stepping motors 86 and 87 are motors of types that are driven and controlled by step signals, the driving sources are not limited to these types of motors, but various types of motors are applicable as driving sources.

As described above, the image forming apparatus 10 forms a color toner image on the surface of the intermediate transfer belt 5 by causing the plurality of image forming portions 1-4 to transfer toner images of different colors onto the intermediate transfer belt 5 while the belt is running so that the toner images are overlaid with each other. Furthermore, the image forming apparatus 10 forms a color image on a printing paper sheet by causing the second transfer device 15 to transfer the toner image from the intermediate transfer belt 5 to the printing paper sheet. Note that, as another embodiment, the intermediate transfer belt 5 may be used as a transport belt, and the toner images may be overlaid with each other directly on a printing paper sheet while the paper sheet is transported on the transport belt. Also, as still another embodiment, an intermediate transfer member shaped like a roller may be used in place of the intermediate transfer belt 5.

Figure 3:
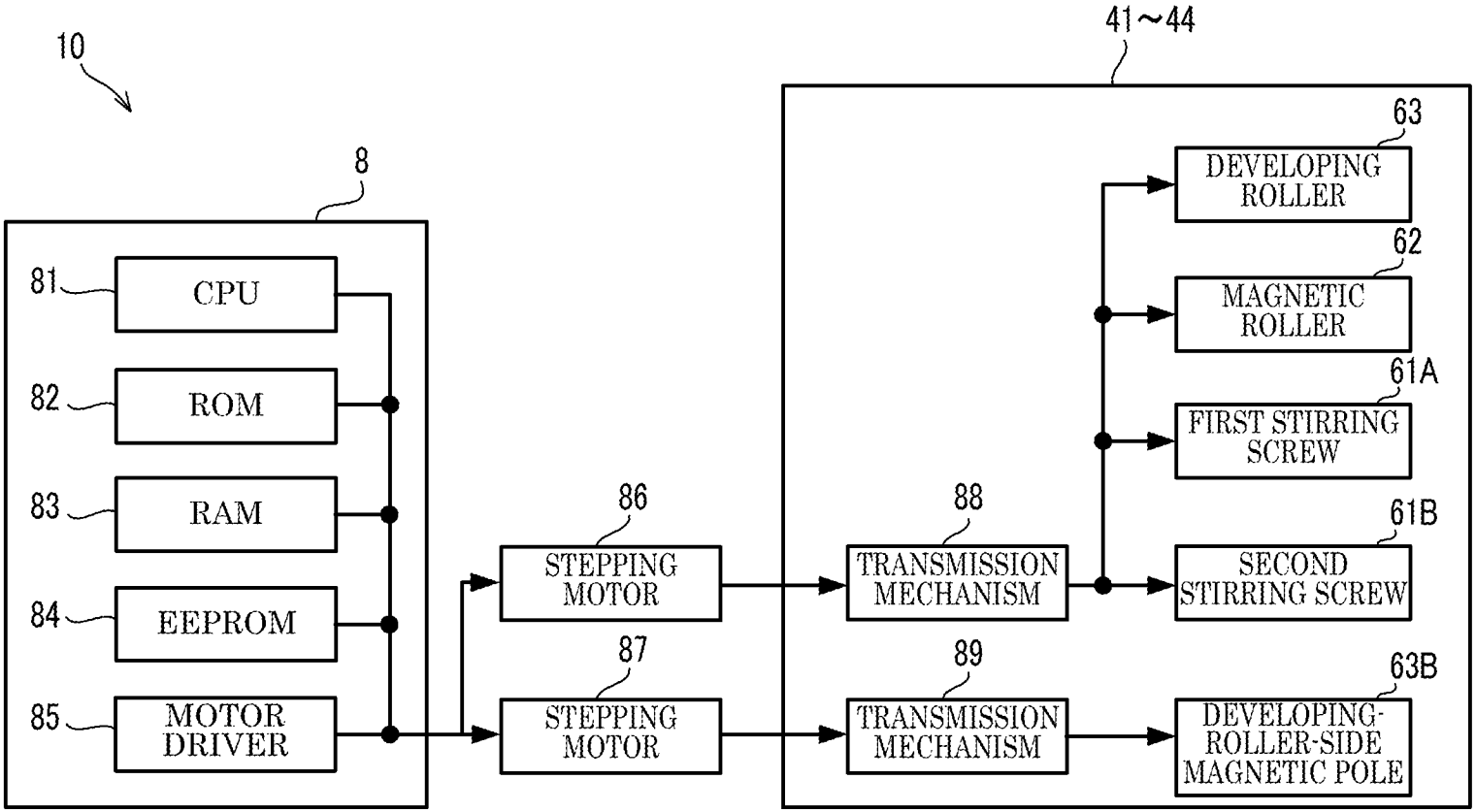
FIG. 3 is a block diagram showing the structure of the controller included in the image forming apparatus shown in FIG. 1.

Next, the functions of the controller 8 are briefly explained with reference to FIG. 3. The controller 8 controls the image forming apparatus 10 as a whole. As shown in FIG. 3, the controller 8 includes a CPU 81, a ROM 82, a RAM 83, an EEPROM 84, a motor driver 85 and the like. The ROM 82 is a non-volatile storage device, the RAM 83 is a volatile storage device, and the EEPROM 84 is a non-volatile storage device. The RAM 83 and the EEPROM 84 are used as temporary storage memories by various processes executed by the CPU 81. The motor driver 85 drives and controls the stepping motors 86 and 87 based on the control signals from the CPU 81. The ROM 82 stores a predetermined control program.

The controller 8 controls the image forming apparatus 10 as a whole when the CPU 81 executes the predetermined control program stored in the ROM 82. More specifically, the ROM 82 stores a program (an image formation process program) for realizing an image formation. Furthermore, the ROM 82 stores a movement control program for moving the developing-roller-side magnetic pole 63B, which is included in each of the developing devices 41-44, between a first position and a second position that are described below, during the non-developing period when the developing devices 41-44 do not perform the developing process.

Figure 4A:
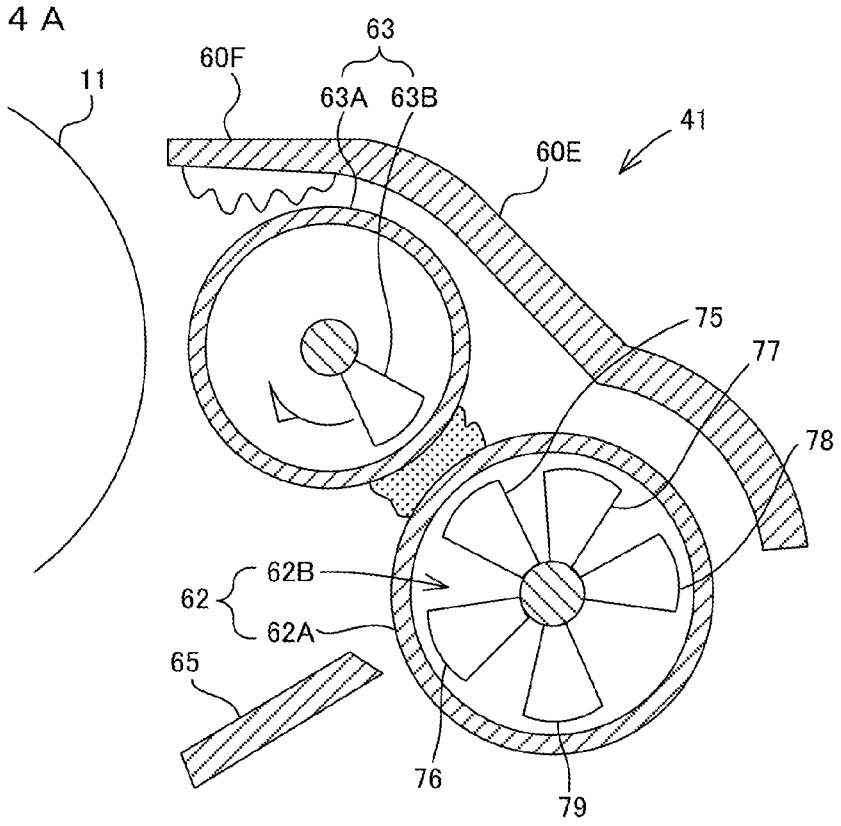
FIGS. 4A and 4B are schematic diagrams showing the operation states of the developing roller included in the developing device shown in FIG. 2.

The controller 8 causes the CPU 81 to execute various types of arithmetic processes in accordance with the movement control program, and to execute a driving control by using the motor driver 85. With this operation, during the non-developing period, the developing-roller-side magnetic pole 63B is rotated and moved between the first position and the second position as described below. More specifically, the controller 8 causes the developing-roller-side magnetic pole 63B to move from the first position (the position shown in FIG. 4A) described below to the second position (the position shown in FIG. 5A) described below by causing the motor driver 85 to drive and control the stepping motor 87. After this movement, the controller 8 moves the developing-roller-side magnetic pole 63B to the first position again. When the developing-roller-side magnetic pole 63B is moved in this way, toner having adhered to the inner walls and the like of each of the developing devices 41-44 is collected by a magnetic carrier that moves together with the developing-roller-side magnetic pole 63B by the magnetic force of the developing-roller-side magnetic pole 63B. The movement controller of the present disclosure is realized by the controller 8 that performs the arithmetic processes and driving control as described above. The movement of the developing-roller-side magnetic pole 63B and the first and second positions are described below. Note that the controller 8 may be an electronic circuit such as an integrated circuit (ASIC, DSP or the like). Also, the controller 8 may be provided independently from a main controller that controls the image forming apparatus 10 as a whole.

Figure 2:
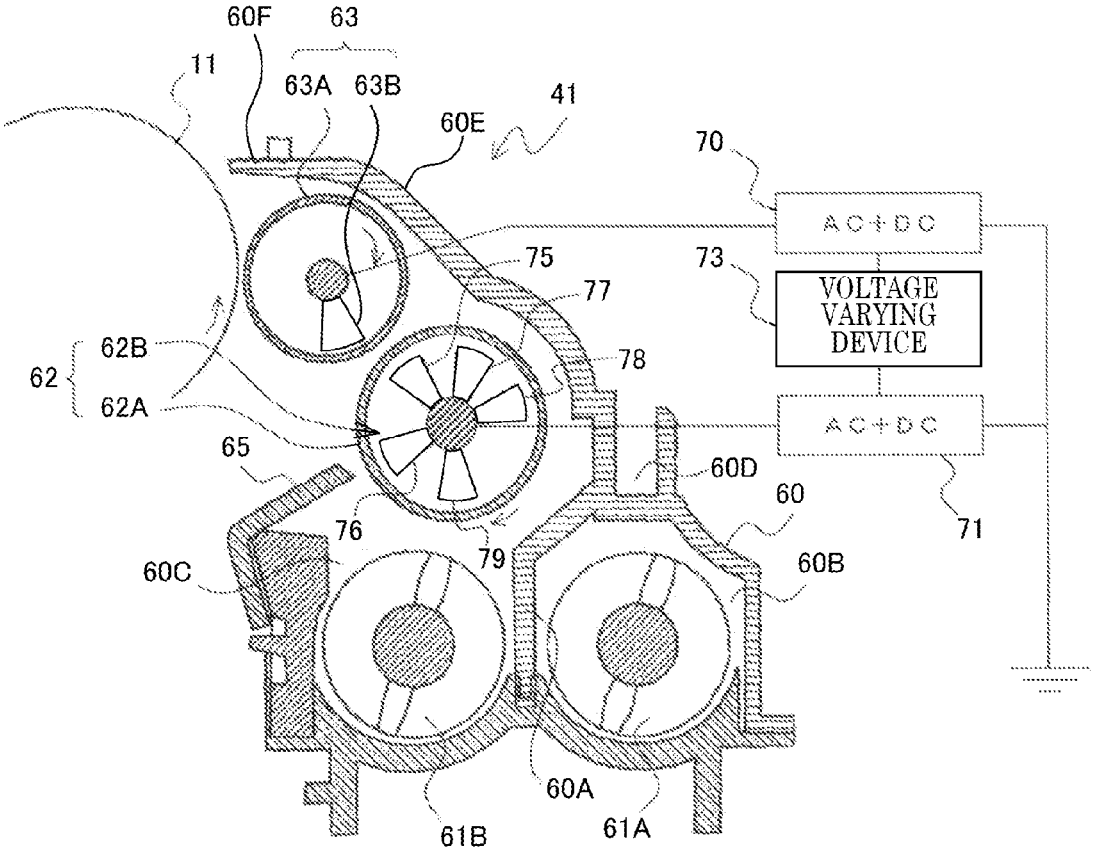
FIG. 2 is a sectional diagram showing the structure of the developing device in the embodiment of the present disclosure.

FIG. 2 is a sectional diagram showing the structure of the developing device 41 included in the image forming portion 1. The following describes the structure of the developing device 41 with reference to FIG. 2. Note that the other developing devices 42-44 have the same structure as the developing device 41, and thus detailed description thereof is omitted.

As shown in FIG. 2, the developing device 41 includes a developer container 60 for storing two-component developer (hereinafter, merely referred to as developer). The developer container 60 plays a role of a cabinet of the developing device 41, as well as storing the developer. The developer container 60 is partitioned into a first stirring chamber 60B and a second stirring chamber 60C by a partition wall 60A. In the first stirring chamber 60B and the second stirring chamber 60C, the first stirring screw 61A and the second stirring screw 61B are rotatably provided, respectively. The first stirring screw 61A and the second stirring screw 61B mix toner (positively chargeable toner) supplied from a toner container (not shown) with magnetic carrier and stir them to charge the toner.

The developer is transported in a rotation direction around the axis by the first stirring screw 61A and the second stirring screw 61B while being stirred. While being transported in the developer container 60, the developer is passed through a developer passage (not shown) formed in the partition wall 60A, thereby being circulated between the first stirring chamber 60B and the second stirring chamber 60C.

Note that in the developer container 60, a toner density sensor (not shown) is provided to face the first stirring screw 61A. In the developing device 41, toner is supplied from a supply device (not shown) into the developer container 60 via a toner supply port 60D in accordance with the toner density detected by the toner density sensor.

The magnetic roller 62 and the developing roller 63 are provided in the developer container 60. The magnetic carrier with toner adhered thereto is held by the roller surface of the magnetic roller 62. The developing roller 63 is provided to face the magnetic roller 62. More specifically, the magnetic roller 62 is provided above the second stirring screw 61B. The developing roller 63 is arranged at the upper left of the magnetic roller 62 so as to face the magnetic roller 62. That is to say, the magnetic roller 62 is arranged at a lower position than the developing roller 63. In the present embodiment, the magnetic roller 62 and the developing roller 63 are arranged to have a predetermined distance between facing positions (opposed positions) thereof at which they face each other. The developing roller 63 faces the photosensitive drum 11 at the opening of the developer container 60 (on the left-hand side of FIG. 2). That is to say, the developing roller 63 is arranged to face the outer circumferential surface of the photosensitive drum 11. The magnetic roller 62 and the developing roller 63 are rotated clockwise in FIG. 2.

As shown in FIG. 2, the developer container 60 extends diagonally upward left. More specifically, in FIG. 2, a partition wall 60E, which is provided at the upper right of the developer container 60, first extends diagonally upper left, then at a position above the developing roller 63, extends horizontally leftward (toward the photosensitive drum 11). In the present embodiment, a horizontal wall 60F, which is an end of the partition wall 60E, horizontally extends above the developing roller 63 to an extent that it covers the developing roller 63. That is to say, the horizontal wall 60F is provided above the developing roller 63 and covers the developing roller 63. Also, there is no other member provided between the horizontal wall 60F of the partition wall 60E and the roller surface of the developing roller 63. As a result, a gap is formed between the horizontal wall 60F and the roller surface of the developing roller 63 such that at least the toner and the magnetic carrier can pass through the gap. That is to say, the horizontal wall 60F is provided separately from the roller surface of the developing roller 63 with the gap therebetween. The horizontal wall 60F of the partition wall 60E is an example of the cover of the present disclosure.

The magnetic roller 62 includes a non-magnetic rotating sleeve 62A and a magnetic-roller-side magnetic pole 62B that includes a plurality of magnetic poles. The rotating sleeve 62A is rotatably supported by a frame (not shown) of the developing device 41. The magnetic-roller-side magnetic pole 62B is contained in the rotating sleeve 62A. That is to say, the magnetic-roller-side magnetic pole 62B is provided inside the rotating sleeve 62A. The magnetic-roller-side magnetic pole 62B is fixed to the inside of the rotating sleeve 62A. In the present embodiment, the magnetic-roller-side magnetic pole 62B has magnetic poles of five poles: a main pole 75 (an example of the first magnetic force generator of the present disclosure); a restriction pole (a brush-clipping magnetic pole) 76; a carrying pole 77; a peeling pole 78; and a draw-up pole 79. The magnetic poles 75-79 may be, for example, permanent magnets that generate magnetic forces.

The main pole 75 is attached to the magnetic-roller-side magnetic pole 62B such that the magnetic pole face of the main pole 75 faces the developing roller 63. The main pole 75 forms, with the developing-roller-side magnetic pole 63B provided in the developing roller 63, a magnetic field in which they pull each other.

The developer container 60 is provided with a brush-clipping blade 65. The brush-clipping blade 65 extends along a longitudinal direction of the magnetic roller 62 (namely in the direction perpendicular to a plane of FIG. 2). The brush-clipping blade 65 is arranged on the upstream side of a position at which the developing roller 63 faces the magnetic roller 62, in the rotational direction of the magnetic roller 62. There is a short distance (a small gap) between the edge of the brush-clipping blade 65 and the roller surface of the magnetic roller 62.

The restriction pole 76 is attached to the magnetic-roller-side magnetic pole 62B such that the magnetic pole face of the restriction pole 76 faces the brush-clipping blade 65. That is to say, the restriction pole 76 and the brush-clipping blade 65 are arranged to face each other. The brush-clipping blade 65 is made of, for example, a non-magnetic material or a magnetic material. Since the brush-clipping blade 65 faces the restriction pole 76 of the magnetic-roller-side magnetic pole 62B, a magnetic field in which they pull each other is generated in a gap between the brush-clipping blade 65 and the rotating sleeve 62A. With the presence of this magnetic field, a magnetic brush is formed between the brush-clipping blade 65 and the rotating sleeve 62A.

The developing roller 63 includes a cylindrical developing sleeve 63A and a developing-roller-side magnetic pole 63B (an example of the second magnetic force generator of the present disclosure). The developing sleeve 63A is rotatably supported by a frame (not shown) of the developing device 41. The developing-roller-side magnetic pole 63B is contained in the developing sleeve 63A. That is to say, the developing-roller-side magnetic pole 63B is provided inside the developing sleeve 63A. The developing-roller-side magnetic pole 63B may be, for example, a permanent magnet that generates a magnetic force. When the developing-roller-side magnetic pole 63B is arranged at the first position that is described below, a magnetic field is generated between the developing-roller-side magnetic pole 63B and the main pole 75 of the magnetic roller 62 such that they pull each other in the magnetic field. As a result, the developing-roller-side magnetic pole 63B and the main pole 75 have different polarities.

The developing-roller-side magnetic pole 63B is rotatably supported inside the developing sleeve 63A. More specifically, in FIG. 2, the developing-roller-side magnetic pole 63B is arranged rotatably with its central axis functioning as a spindle. The central axis of the developing-roller-side magnetic pole 63B matches the rotation center of the developing sleeve 63A. As a result, the developing-roller-side magnetic pole 63B and the developing sleeve 63A rotate concentrically around the central axis.

As shown in FIG. 2, a first bias circuit 70 is connected to the developing roller 63. The first bias circuit 70 applies a DC voltage (hereinafter referred to as "Vslv(DC)") and an AC voltage (hereinafter referred to as "Vslv(AC)") to the developing roller 63. A second bias circuit 71 is connected to the magnetic roller 62. The second bias circuit 71 applies a DC voltage (hereinafter referred to as "Vmag(DC)") and an AC voltage (hereinafter referred to as "Vmag(AC)") to the magnetic roller 62. The first bias circuit 70 and the second bias circuit 71 are grounded to the same ground.

A voltage varying device 73 is connected to the first bias circuit 70 and the second bias circuit 71. The voltage varying device 73 can vary the Vslv(DC) and the Vslv(AC) to be applied to the developing roller 63, and can vary the Vmag (DC) and the Vmag(AC) to be applied to the magnetic roller 62.

As described above, the developer is stirred by the first stirring screw 61A and the second stirring screw 61B while being circulated in the developer container 60 and thereby charging the toner, and the second stirring screw 61B transports the developer to the magnetic roller 62. Also, the brush-clipping blade 65 is arranged to face the restriction pole 76 of the magnetic-roller-side magnetic pole 62B. As a result, a magnetic brush is formed on the rotating sleeve 62A by the brush-clipping blade 65 as the rotating sleeve 62A rotates. The magnetic brush on the magnetic roller 62 is restricted in layer thickness by the brush-clipping blade 65, and then moves to a position facing the developing roller 63 as the rotating sleeve 62A rotates. At this position, the magnetic brush is influenced by the magnetic field in which the main pole 75 of the magnetic-roller-side magnetic pole 62B and the developing-roller-side magnetic pole 63B pull each other. As a result, the magnetic brush contacts with the roller surface of the developing roller 63. This causes toner adhered to the magnetic carrier of the magnetic brush to be transferred to the developing roller 63. Also, due to the magnetic field and a potential difference ΔV between Vmag(DC) applied to the magnetic roller 62 and Vslv(DC) applied to the developing roller 63, a toner thin layer is formed on the roller surface of the developing roller 63.

Note that the toner thin layer on the developing roller 63 varies in layer thickness depending on the resistance of the developer, the difference in rotation speed between the magnetic roller 62 and the developing roller 63, and the like. However, the toner layer thickness can be controlled by the potential difference ΔV. The increase in the potential difference ΔV causes the toner layer on the developing roller 63 to be thicker, and the decrease in the potential difference ΔV causes the toner layer to be thinner. An appropriate range of the potential difference ΔV is approximately from 100V to 350V.

The toner thin layer formed on the developing roller 63 by the magnetic brush is transported with the rotation of the developing roller 63 to a position where the photosensitive drum 11 and the developing roller 63 face each other. Since a voltage has been applied to the developing roller 63, toner flies due to the potential difference between the developing roller 63 and the photosensitive drum 11. This causes the electrostatic latent image on the photosensitive drum 11 to be developed.

When the rotating sleeve 62A of the magnetic roller 62 further rotates clockwise, the magnetic brush is separated from the roller surface of the developing roller 63 due to a magnetic field in a horizontal direction (a circumferential direction of the roller) that is caused by the carrying pole 77 that is adjacent to and has a different polarity from the main pole 75. As a result, toner, which remains without being used in the developing, is collected from the developing roller 63 onto the rotating sleeve 62A. When the rotating sleeve 62A further rotates, it is influenced by a repelling magnetic field that is caused by the peeling pole 78 and the draw-up pole 79, both having the same polarity, of the magnetic-roller-side magnetic pole 62B. This causes the toner to be separated from the rotating sleeve 62A within the developer container 60. The toner is then stirred and transported by the second stirring screw 61B, and is held on the rotating sleeve 62A again by the draw-up pole 79 as a two-component developer having appropriate toner density and having been uniformly charged. The toner then forms the magnetic brush again on the rotating sleeve 62A and is transported to the brush-clipping blade 65.

Meanwhile, in the developing device 41 shown in FIG. 2, when toner flies and transfers from the developing roller 63 to the photosensitive drum 11, or when toner transfers from the magnetic roller 62 to the developing roller 63, a part of the toner flies inside the developing device 41. The flying toner may adhere to and be accumulated on the inner wall of the developer container 60 of the developing device 41. In particular, toner, which flies during the developing, is likely to adhere to the horizontal wall 60F that is located close to a position where the photosensitive drum 11 and the developing roller 63 face each other. When a block of uncollected toner, which has adhered to the horizontal wall 60F and grown, peels and drops on the developing sleeve 63A or the photosensitive drum 11, the toner layer on the developing roller 63 may be damaged, or the amount of toner held by the developing roller 63 may be varied. Furthermore, it may cause an excessive amount of toner to be supplied to the image-carrying member such as the photosensitive drum 11. In such cases, the formed image may be degraded in quality, and a defective image may be generated.

Figure 4B:
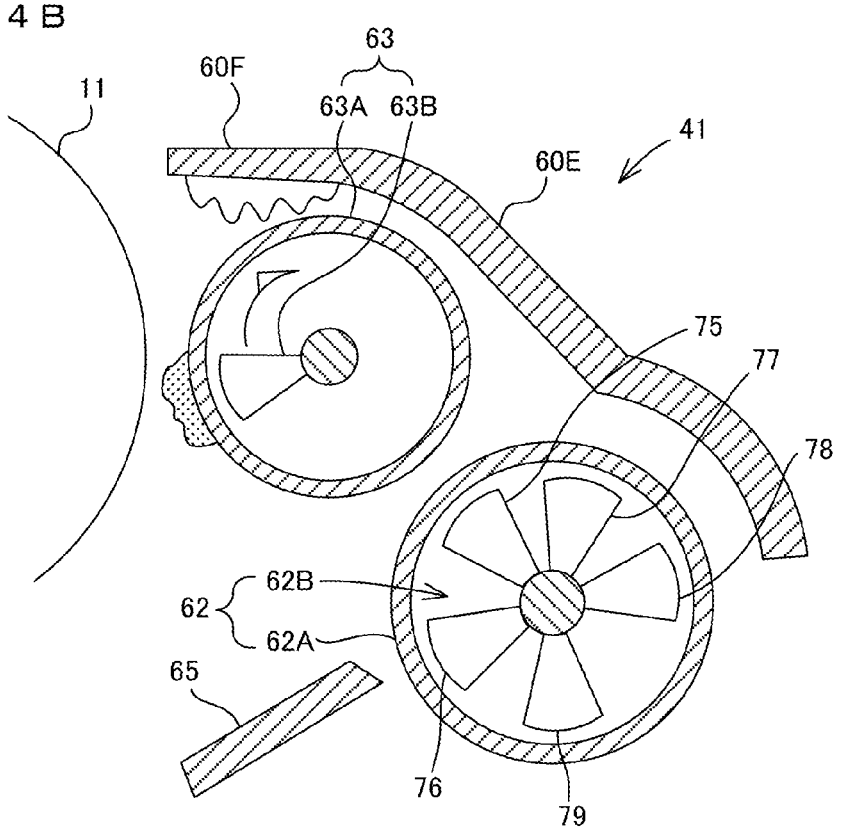
Figure 5A:
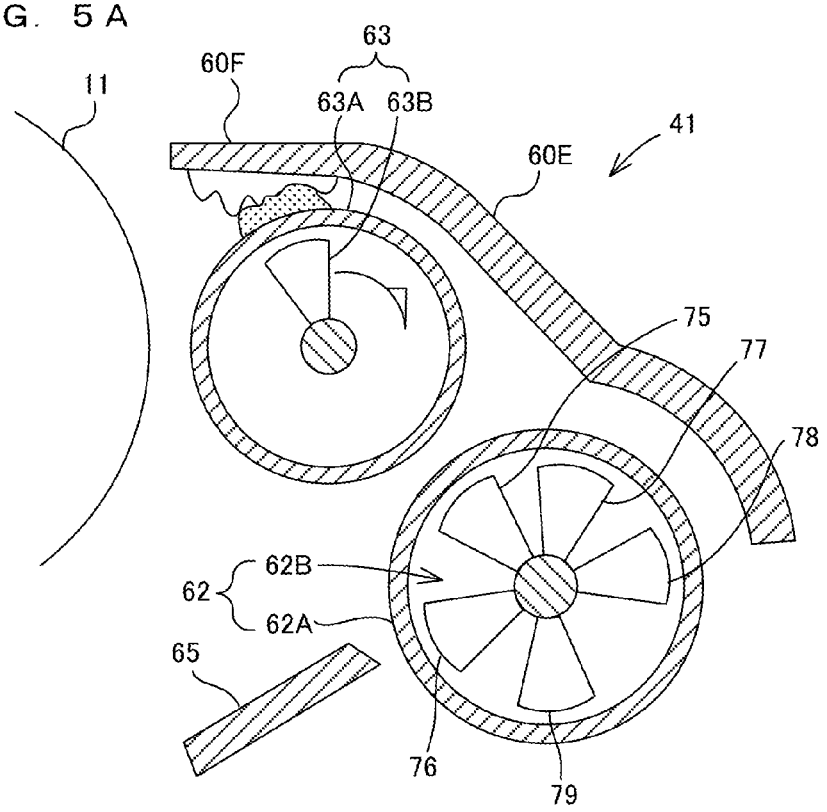
FIGS. 5A and 5B are schematic diagrams showing the operation states of the developing roller included in the developing device shown in FIG. 2.

In view of the above problem, in the developing device 41 of the present embodiment, the developing-roller-side magnetic pole 63B is structured to be able to rotate and move between the first position (the position shown in FIG. 4A) and the second position (the position shown in FIG. 5A). The first position is a position at which the magnetic pole face of the developing-roller-side magnetic pole 63B faces the magnetic roller 62. The second position is a position at which the magnetic pole face of the developing-roller-side magnetic pole 63B faces the horizontal wall 60F of the partition wall 60E. The developing-roller-side magnetic pole 63B is rotated clockwise from the first position (see FIG. 4A) when the controller 8 drives and controls the stepping motor 87 during the non-developing period when the developing process is not performed (see FIG. 4B). This rotation is continued until the developing-roller-side magnetic pole 63B moves to the second position (see FIG. 5A). The developing-roller-side magnetic pole 63B is further rotated clockwise until it returns to the first position (see FIG. 5B).

Figure 5B:
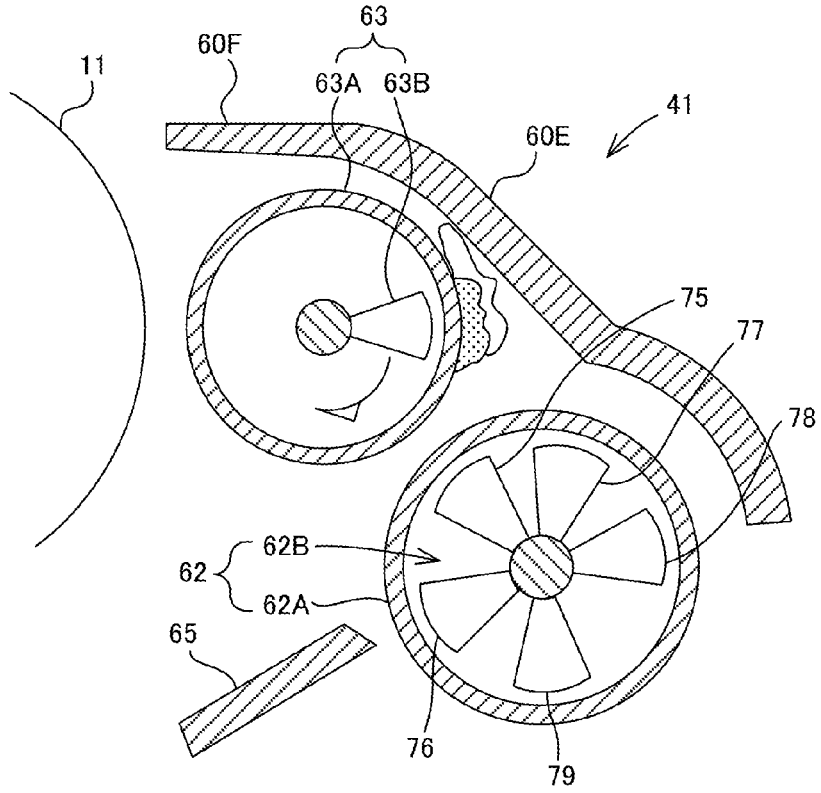

In the process of the above-described rotational movement, the developing-roller-side magnetic pole 63B, while moving clockwise from the first position, causes the magnetic carrier, which is contained in the magnetic brush and present at a position at which the developing roller 63 faces the magnetic roller 62, to be adsorbed on the roller surface of the developing sleeve 63A by the magnetic force. With the magnetic carrier being adsorbed on the roller surface of the developing sleeve 63A, the developing-roller-side magnetic pole 63B rotates and moves from the first position to the second position. This rotation of the developing-roller-side magnetic pole 63B causes the magnetic carrier to be transported clockwise along the roller surface of the developing sleeve 63A (see FIG. 4B). Subsequently, as shown in FIG. 5A, when the rotation of the developing-roller-side magnetic pole 63B transports the magnetic carrier to a position under the horizontal wall 60F, the magnetic carrier contacts with uncollected toner that has adhered to the horizontal wall 60F. This causes the uncollected toner to be adhered to the magnetic carrier and collected. Subsequently, as shown in FIG. 5B, when the developing-roller-side magnetic pole 63B further rotates clockwise, the magnetic carrier and the uncollected toner are transported toward the magnetic roller 62.

As described above, in the developing device 41, the developing-roller-side magnetic pole 63B is rotated during the non-developing period. This enables the uncollected toner, which has adhered to the horizontal wall 60F, to be collected reliably. Thus, with this structure, it is possible to prevent a block of toner, which has adhered to the horizontal wall 60F, from dropping and causing a defective image. Accordingly, performing the developing process after collecting the uncollected toner as described above makes it possible to develop a toner image that is stable and has no dispersion, on the photosensitive drum 11.

The present embodiment describes, as an example, a case where only the developing-roller-side magnetic pole 63B is rotated. However, not limited to this, when the developing-roller-side magnetic pole 63B is rotated clockwise from the first position to the second position, the developing sleeve 63A may be rotated at the same timing and in the same rotational direction (clockwise) as the developing-roller-side magnetic pole 63B. With this structure, the magnetic carrier is transported without sliding on the roller surface of the developing sleeve 63A. Thus, a more amount of magnetic carrier can be transported to the horizontal wall 60F. Note that the rotational speed of the developing-roller-side magnetic pole 63B may be set to be slightly slower than the rotational speed of the developing sleeve 63A.

Also, the present embodiment describes, as an example, a case where the developing-roller-side magnetic pole 63B is rotated clockwise. However, not limited to this, the developing-roller-side magnetic pole 63B may be rotated counterclockwise from the first position to the second position, for example. In this case, the developing-roller-side magnetic pole 63B may be further rotated counterclockwise so that it moves from the second position, passes the position facing the photosensitive drum 11, and returns to the first position. Also, in this case, to prevent the toner, which has been collected from under the horizontal wall 60F, from being transferred to the photosensitive drum 11 when the developing-roller-side magnetic pole 63B passes the position facing the photosensitive drum 11, the developing-roller-side magnetic pole 63B having reached the second position may be rotated in an opposite direction (clockwise) to return from the second position to the first position.

Furthermore, the direction of the rotational movement of the developing-roller-side magnetic pole 63B may be switched between the clockwise direction and the counterclockwise direction. For example, normally, the developing-roller-side magnetic pole 63B may be rotated in a predetermined direction (clockwise) to collect the uncollected toner, and after the toner collection operation is performed predetermined times, the developing-roller-side magnetic pole 63B may be rotated in an opposite direction (counterclockwise) to collect the uncollected toner.

Furthermore, in the state where the developing-roller-side magnetic pole 63B has returned to the first position, the magnetic carrier is adsorbed on the roller surface of the developing sleeve 63A. In this state, the collected toner, together with the magnetic carrier, needs to be transported into the developer container 60. To fulfill this need, the magnetic roller 62 may be rotated in the direction in which it is rotated during the developing process, namely, clockwise in FIG. 2, at the timing when the developing-roller-side magnetic pole 63B returns to the first position. With this structure, it is possible to collect the toner that has adhered to the horizontal wall 60F, as well as to cause the first stirring screw 61A and the second stirring screw 61B to stir the toner so that the toner can be used as a uniformly charged toner again.

Furthermore, before the developing-roller-side magnetic pole 63B is rotated from the first position, a process for increasing the amount of magnetic carrier that exists in the space between the developing roller 63 and the magnetic roller 62 may be executed. As one example of this process, the potential of the developing roller 63 may be set to be higher than that of the magnetic roller 62. As another example of this process, as shown in FIG. 2, when, during the developing period, the developing-roller-side magnetic pole 63B is arranged at a third position (the position indicated in FIG. 2) which is a predetermined distance away from the first position toward the second position, the developing-roller-side magnetic pole 63B may be moved from the third position to the first position during the non-developing period, to enhance the strength of the magnetic field between the developing roller 63 and the magnetic roller 62. With this structure where a larger amount of magnetic carrier exists in the space between the developing roller 63 and the magnetic roller 62, it is possible for the developing-roller-side magnetic pole 63B to transport a larger amount of magnetic carrier to the horizontal wall 60F, enabling a larger amount of uncollected toner to be collected.

Figure 6:
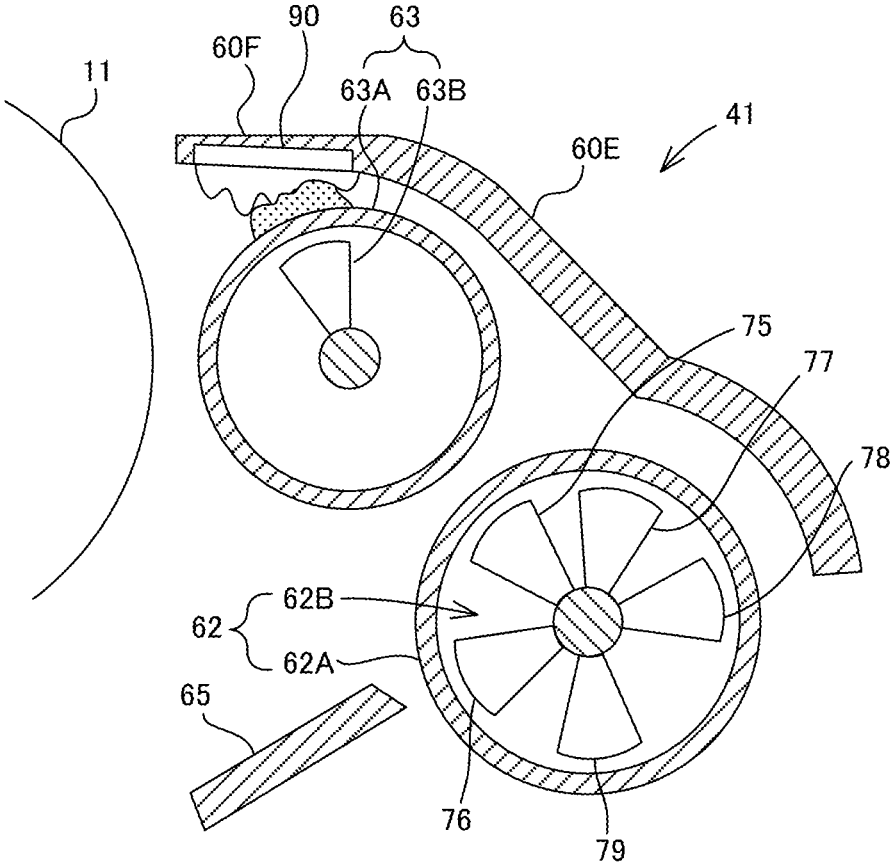
FIG. 6 is a diagram showing a magnetic substance provided in the cabinet of the developing device shown in FIG. 2.

Furthermore, it is possible to adopt a structure where a large magnetic field is formed between the developing-roller-side magnetic pole 63B and the horizontal wall 60F when the developing-roller-side magnetic pole 63B reaches the second position. More specifically, as shown in FIG. 6, a magnetic substance 90 may be provided in the horizontal wall 60F at the surface portion facing the developing roller 63. Alternatively, a magnetic pole with a different polarity from the developing-roller-side magnetic pole 63B may be provided in place of the magnetic substance 90. With this structure, a large magnetic field is formed between the developing-roller-side magnetic pole 63B and the horizontal wall 60F, and the magnetic carrier having reached the horizontal wall 60F is caused to contact with the horizontal wall 60F by the force of the magnetic field. This allows for the magnetic carrier to adsorb and collect more amount of toner that has adhered to the horizontal wall 60F, in a more reliable manner.

The present embodiment describes a case where toner that has adhered to the horizontal wall 60F is collected. However, of course, not limited to the collection of toner that has adhered to the horizontal wall 60F, the present disclosure is applicable to the collection of toner that has adhered to the wall surface of the partition wall 60E or other wall.

Furthermore, not limited to the tandem image forming apparatus 10 shown in FIG. 1, the present disclosure is applicable to various types of image forming apparatuses, such as a digital or analog monochrome copier, a monochrome printer and a rotary developing color printer and color copier, and a facsimile machine, provided with a developing device that uses a two-component developer composed of the magnetic carrier and the toner to develop an electrostatic latent image on the image-carrying member, by causing the developing roller 63 to hold only the charged toner. Of course, not limited to the image forming apparatus 10, the present disclosure may be realized as the developing device 41 as an independent device.

It is to be understood that the embodiments herein are illustrative and not restrictive, since the scope of the invention is defined by the appended claims rather than by the description preceding them, and all changes that fall within metes and bounds of the claims, or equivalence of such metes and bounds thereof are therefore intended to be embraced by the claims.

The invention claimed is:

1. A developing device comprising:

a magnetic roller whose roller surface holds toner and magnetic carrier, the toner being adhered to the magnetic carrier;

a developing roller arranged to face the magnetic roller;

a cover covering the developing roller and arranged at a predetermined distance from a roller surface of the developing roller;

a first magnetic force generator provided inside the magnetic roller in a state where a magnetic pole face of the first magnetic force generator faces the developing roller;

a second magnetic force generator provided inside the developing roller so as to be able to move between a first position and a second position, a magnetic pole face of the second magnetic force generator facing the magnetic roller at the first position and facing the cover at the second position, the first magnetic force generator and the second magnetic force generator having different polarities; and a movement controller causing the second magnetic force generator to move from the first position to the second position, and subsequently to move to the first position, wherein the second magnetic force generator moves between the first position and the second position in a state where the magnetic carrier is adsorbed on the roller surface of the developing roller by a magnetic force, and when the magnetic carrier adsorbed on the roller surface passes through a gap with the predetermined distance between the cover and the roller surface, the magnetic carrier collects uncollected toner that has adhered to the cover.

2. The developing device according to claim 1, wherein the movement controller causes the second magnetic force generator to move from the first position to the second position during a non-developing period.

3. The developing device according to claim 2, wherein during a developing period, the second magnetic force generator is arranged at a third position which is a predetermined distance away from the first position toward the second position, and during the non-developing period, the movement controller causes the second magnetic force generator to move from the third position to the first position, subsequently to move to the second position, and subsequently to move to the first position.

4. The developing device according to claim 1, wherein the second magnetic force generator is supported so as to be able to rotate and move around a rotary axis of the developing roller between the first position and the second position, and the movement controller causes the second magnetic force generator to move from the first position to the second position and subsequently to move to the first position by causing the second magnetic force generator to rotate and move in one direction.

5. The developing device according to claim 1, wherein the second magnetic force generator is supported so as to be able to rotate and move around a rotary axis of the developing roller between the first position and the second position, and the movement controller causes the second magnetic force generator to move from the first position to the second position by causing the second magnetic force generator to rotate and move in one direction, and causes the second magnetic force generator to move from the second position to the first position by causing the second magnetic force generator to rotate and move in an opposite direction.

6. The developing device according to claim 1, wherein the developing roller is arranged to face the image-carrying member, the magnetic roller is arranged at a lower position than the developing roller, and the cover is arranged above the developing roller.

7. The developing device according to claim 1, wherein the movement controller causes the second magnetic force generator to move and causes the developing roller to rotate in a same direction as the second magnetic force generator moves.

8. An image forming apparatus comprising the developing device according to claim 1.

* * * * *